US007347516B2

(12) United States Patent
Hay

(10) Patent No.: US 7,347,516 B2
(45) Date of Patent: Mar. 25, 2008

(54) FRICTION SLIDE

(75) Inventor: Michael E. Hay, Buckingham, IA (US)

(73) Assignee: Waterloo Industries, Inc., Waterloo, IA (US)

( * ) Notice: Subject to any disclaimer, the term of this patent is extended or adjusted under 35 U.S.C. 154(b) by 152 days.

(21) Appl. No.: 11/238,941

(22) Filed: Sep. 29, 2005

(65) Prior Publication Data

US 2006/0066190 A1 Mar. 30, 2006

Related U.S. Application Data

(60) Provisional application No. 60/522,424, filed on Sep. 29, 2004.

(51) Int. Cl.
*A47B 88/00* (2006.01)

(52) U.S. Cl. ..... 312/333; 312/334.46

(58) Field of Classification Search ..... 312/334.1, 312/334.7, 334.8, 334.16, 334.36, 334.44, 312/334.46, 333
See application file for complete search history.

(56) References Cited

U.S. PATENT DOCUMENTS

| | | | | | |
|---|---|---|---|---|---|
| 700,721 | A | | 5/1902 | Ames | |
| 1,231,291 | A | * | 6/1917 | Otte | 312/334.8 |
| 1,247,712 | A | | 11/1917 | Ohnstrand | |
| 1,477,278 | A | | 12/1923 | O'Connor | |
| 1,569,158 | A | | 1/1926 | Tobey | |
| 1,958,686 | A | | 5/1934 | Vanderhoof | |
| 2,277,703 | A | * | 3/1942 | Kennedy et al. | 384/21 |
| 2,295,697 | A | * | 9/1942 | Sulentic | 312/334.8 |
| 2,528,910 | A | | 11/1950 | Poe | |
| 2,815,252 | A | * | 12/1957 | Baker | 384/23 |
| 2,859,070 | A | | 11/1958 | Gomersall | |
| 3,033,638 | A | * | 5/1962 | Tomlinson | 312/334.8 |
| 3,092,429 | A | | 6/1963 | Barnes | |
| 3,123,419 | A | | 3/1964 | Maxwell | |
| 3,124,402 | A | | 3/1964 | Rhoads | |
| 3,320,003 | A | * | 5/1967 | Edelson et al. | 384/35 |
| 3,572,874 | A | | 3/1971 | Hassel | |
| 3,624,703 | A | | 11/1971 | Pavek | |
| 3,649,090 | A | * | 3/1972 | Dutot | 384/23 |
| 3,743,366 | A | * | 7/1973 | Tazaki | 384/18 |
| 4,065,196 | A | | 12/1977 | Stein | |
| 4,072,375 | A | * | 2/1978 | Boone | 312/334.8 |
| 4,090,753 | A | | 5/1978 | Rock et al. | |

(Continued)

FOREIGN PATENT DOCUMENTS

CA 2437147 * 2/2005

*Primary Examiner*—Janet M. Wilkens
(74) *Attorney, Agent, or Firm*—Calfee, Halter & Griswold LLP

(57) ABSTRACT

The apparatus and methods reduce the force needed to open and close a drawer, as well as reduce noise generated by friction slide mechanisms when the drawer is opened and closed. A drawer slide mechanism includes a first elongated track, an elongated rail, and a low friction material. The rail is telescopically received by the track, by which a path of motion is defined for the rail. The rail remains at least partially received by the track along the entire path of motion of the rail. In addition, the low friction material is disposed between the track and the rail such that the low friction material remains at least partially disposed between the track and the rail throughout the entire path of motion.

25 Claims, 9 Drawing Sheets

U.S. PATENT DOCUMENTS 4,191,436 A 3/1980 Cherry
4,210,303 A * 7/1980 Torta et al. ..... 248/429
4,384,746 A * 5/1983 Ferdinand et al. ..... 384/21
4,440,461 A * 4/1984 Powell et al. ..... 312/334.8
4,516,811 A * 5/1985 Akiyama et al. ..... 384/34
4,681,381 A 7/1987 Sevey
4,861,123 A * 8/1989 Russell ..... 312/330.1
5,433,517 A * 7/1995 Fleisch ..... 312/334.8
5,575,564 A * 11/1996 Harmon et al. ..... 384/34
5,890,811 A * 4/1999 Bryson ..... 384/42
5,927,839 A * 7/1999 Alfaro ..... 312/301
5,951,132 A * 9/1999 Cirocco ..... 312/334.46
6,076,908 A * 6/2000 Maffeo ..... 312/334.7

* cited by examiner

FRICTION SLIDE

CROSS-REFERENCE TO RELATED APPLICATIONS

This non-provisional application claims the benefit of U.S. Provisional Patent Application No. 60/522,424, entitled "Improved Friction Slide," filed Sep. 29, 2004, the specification of which is hereby incorporated in its entirety.

FIELD OF THE INVENTION

The present invention relates generally to friction slide mechanisms and relates specifically to friction slide mechanisms for use in opening and closing drawers contained in cabinets, chests, and the like.

BACKGROUND OF INVENTION

Friction slides are one mechanism by which a drawer located in a cabinet housing or chest can be opened and closed. Friction slide mechanisms are comprised of multiple components, many of which can be made or manufactured from steel and other similar materials. Typically, a force is applied to a handle or other similar device attached to a drawer to pull the drawer out of or push the drawer into a cabinet. As the drawer is pulled out or pushed in, typically at least one friction slide component moves relative to another friction slide component. When these components are in contact with one another, the relative movement of these components can have relatively high levels of friction. These relatively high levels of friction can make it relatively difficult to open or close the drawer, as well as cause unwanted noise as the drawer is opened and closed. It is desirable to develop apparatus and methods that reduce the operational effort and noise associated with using a friction slide mechanism for opening and closing a drawer located within cabinets, chests, or other similar structures.

SUMMARY OF INVENTION

The present invention is directed to apparatus and methods for improving friction slide mechanisms utilized with drawers. The apparatus and methods reduce the force needed to open and close a drawer, as well as reduce noise generated by friction slide mechanisms when the drawer is opened and closed.

In one embodiment of the invention, a drawer slide mechanism includes a first elongated track, an elongated rail, and a low friction material. The rail is telescopically received by the track, by which a path of motion is defined for the rail. The rail remains at least partially received by the track along the entire path of motion of the rail. In addition, the low friction material is disposed between the track and the rail such that the low friction material remains at least partially disposed between the track and the rail throughout the entire path of motion.

In another embodiment of the invention, a drawer slide mechanism includes an outer rail, and inner rail, and a stop. The inner rail is positioned movably adjacent to the outer rail and arranged such that at least a portion of the inner rail remains adjacent to the outer rail throughout the entire range of motion of the inner rail. The stop is coupled to the inner rail and the outer rail includes a protrusion. The stop includes an impact surface for contacting the protrusion when the inner rail is positioned proximate to one end of its range of motion. When the protrusion does contact the stop, the stop is arranged in such a manner to offer elastic resistance to the outer rail.

Further features and advantages of the invention will become apparent from the following detailed description made with reference to the accompanying drawings. The Detailed Description of the Invention merely describes some preferred embodiments of the invention and is not intended to limit the scope of the claims in any way. Indeed, the invention as described by the claims is broader than and unlimited by the preferred embodiments, and the terms in the claims have all their full ordinary meanings.

DETAILED DESCRIPTION

The present invention is directed to apparatus and methods for improving slide mechanisms for drawers located in cabinets, chests, and similar housings. The improvements are directed to reducing the effort needed to open and close a drawer, as well as reducing noise generated by the opening and closing of the drawer. Generally, the present invention reduces the effort needed to open and close the drawer as well as reduces noise through the addition of a low friction material between components that are in contact with one another and move relative to one another as the drawer is opened or closed. Noise can additionally be reduced by incorporating a soft stop into a friction slide mechanism. The soft stop can be positioned to limit the relative movement of components as well as prevent contact between friction slide components and the housing of the cabinet or the drawer. The elastomeric or polymeric nature of a soft stop can limit the noise generated by an impact of components as a drawer is opened and closed.

The illustrations and descriptions included herein generally show and describe a single drawer in a cabinet housing for purposes of example only. However, the present invention includes and is applicable to multiple drawer cabinets, as well as drawers, writing surfaces and the like used in, for example, file cabinets, kitchen cabinets, dressers, bureaus, and the like.

Figure 1:
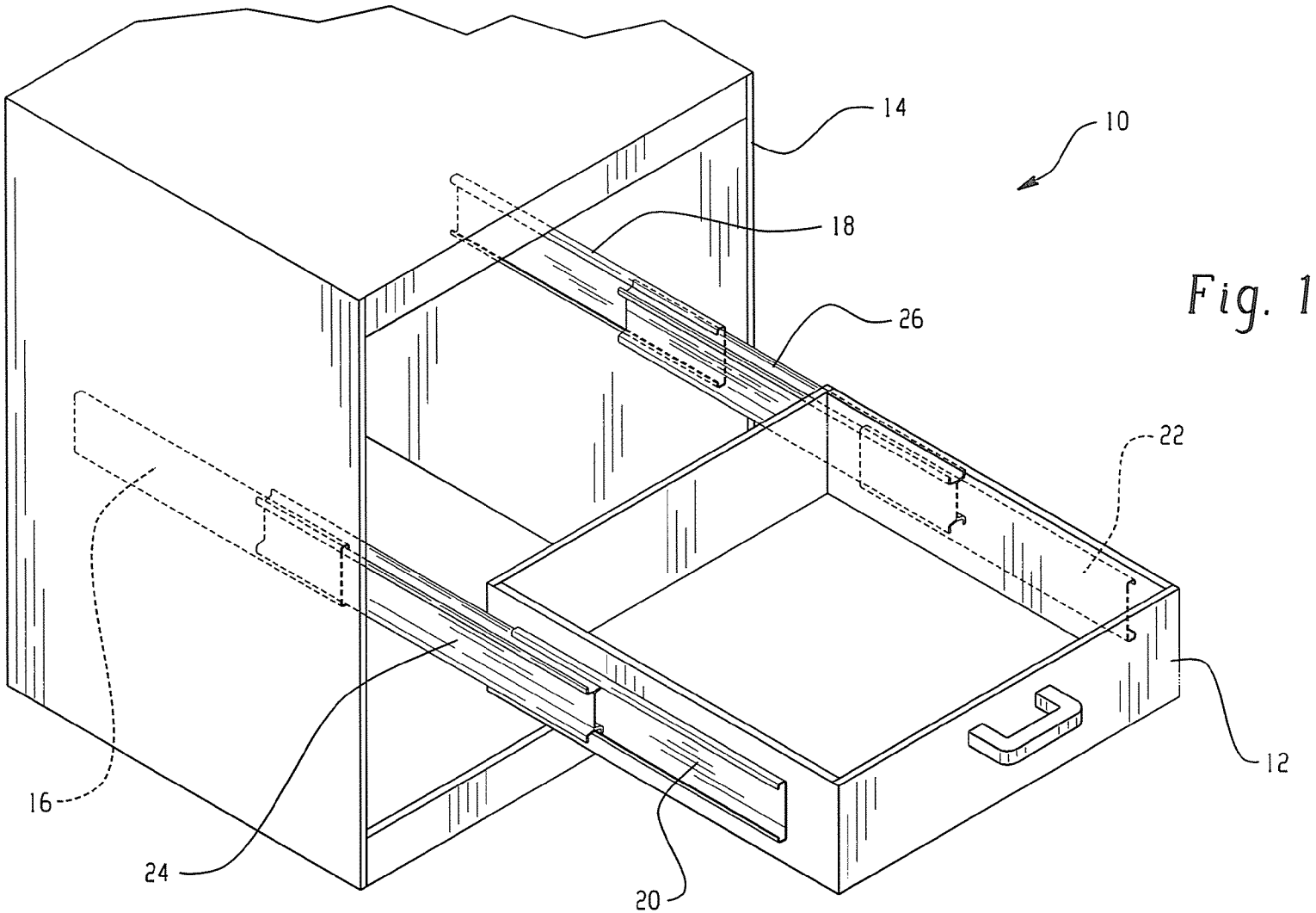
FIG. 1 is a perspective view of a drawer and cabinet including a friction slide mechanism, constructed in accordance with an embodiment of the present invention.

Referring to FIG. 1, an exemplary illustration is shown of a friction slide mechanism used for opening and closing a drawer of a cabinet. A cabinet and drawer assembly 10 includes a drawer 12 and a cabinet housing or chest 14. In this exemplary illustration, the friction slide mechanism includes two pairs of opposing elongated outer rails (16, 18), (20, 22) and a pair of elongated inner rails 24, 26. The first of each pair of outer rails 16, 18 is coupled or otherwise attached to the cabinet 14. The second of each pair of outer rails 20, 22 is coupled or otherwise attached to the drawer 12.

As shown in FIG. 1, the inner rails 24, 26 are positioned to slide within or adjacent to the outer rails 16, 20 and 18, 22, respectively. The inner rails 24, 26 are also free to move relative to the outer rails 16, 20 and 18, 22, respectively, within a certain range of motion. This range of motion of the inner rails 22, 24 can be limited by stops and protrusions (not shown) to ensure that the inner rails 22, 24 remain at least partially within or adjacent to the outer rails 16, 20 and 18, 22, respectively, when the drawer 12 is fully pulled out or fully pushed in.

The exemplary illustrations and descriptions herein show and describe friction slide mechanisms as having outer rails 16, 18 coupled to a cabinet housing 14, outer rails 20, 22 coupled to a drawer 12, and inner rails 24, 26 located within or adjacent to the outer rails 16, 20 and 18, 22, respectively. It should be understood that for all embodiments described and shown herein, a friction slide mechanism can be comprised with only one outer rail 16 and 18 and one inner rail 22 and 24 respectively per each side of the drawer 12. In this arrangement, the outer rails 16 and 18 are coupled to a cabinet housing 14, while the inner rails 24 and 26 are coupled or otherwise attached or incorporated into the drawer 12. Similarly to the description above, the inner rails 24 and 26 are positioned to slide within or adjacent to the outer rails 16 and 18 respectively and are free to move within a certain range of motion. This range of motion can be limited by stops and protrusions.

Figure 2:
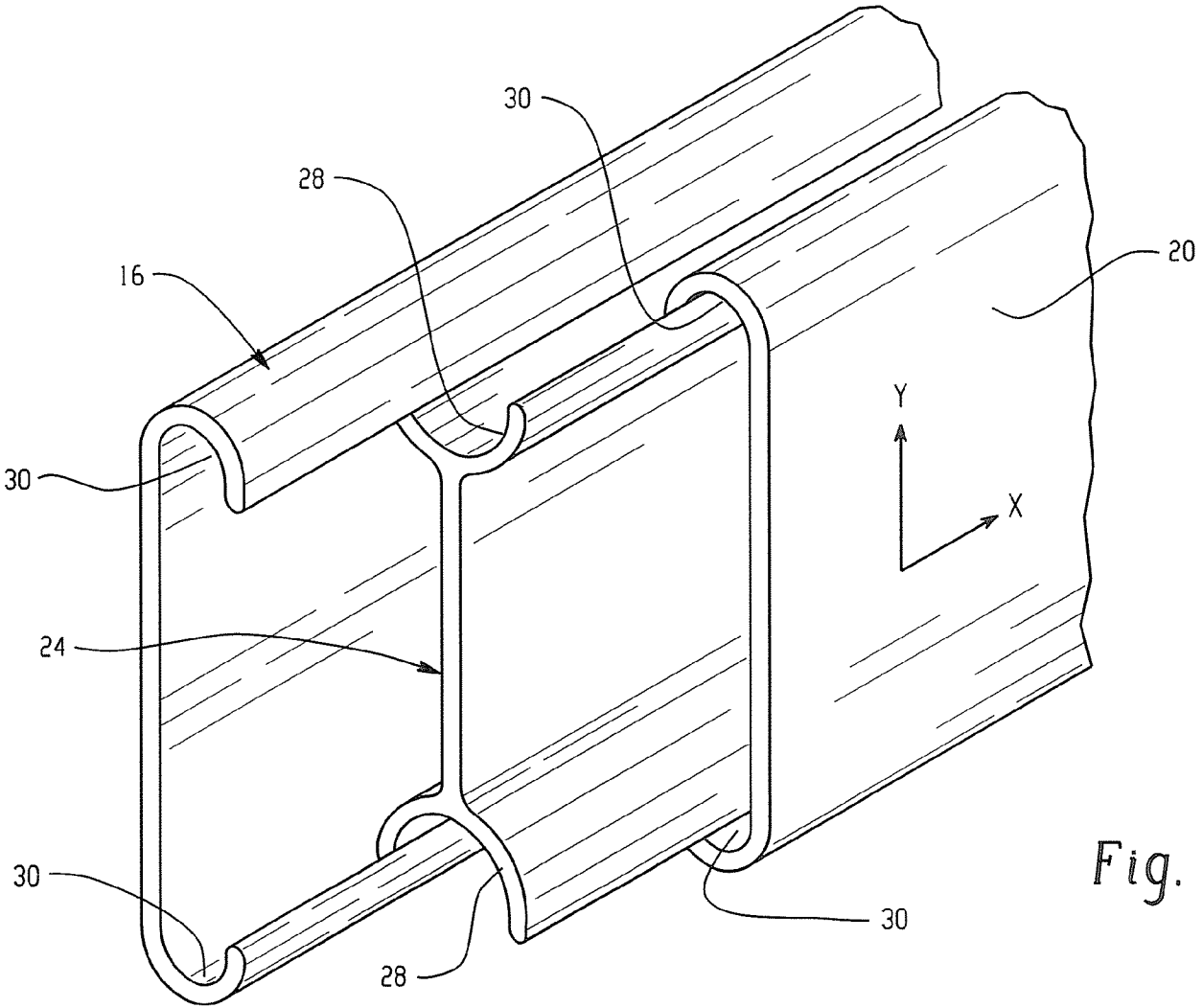
FIG. 2 is a detailed perspective view of a portion of the friction slide mechanism of FIG. 1.

FIG. 2 shows an exemplary illustration of friction slide mechanism components for one side of a drawer. In this example, the two outer rails 16 and 20 and their respective inner rail 24 are shown. One outer rail 16 is typically coupled to the cabinet 14 and the other outer rail 20 is typically coupled to the drawer 12. The outer rails 16 and 20 and inner rail 24 are arranged such that outer rails 16 and 20 function as a track for the inner rail 24, which is telescopically positioned with respect to the outer rails 16 and 20. In other words, the inner rail 24 can move in and out of the outer rails 16 and 20 to accommodate the operator controlled movement of the drawer 12. Although, throughout the entire range of motion, at least a portion of the inner rail 24 is retained by tracks formed by the outer rails 16 and 20.

The rails include interlocking structure shown in FIG. 2. Specifically, in this exemplary illustration, the inner rail 24 includes u-shaped features 28 that are captured in channels 30 located on the outer rails 16 and 20. The u-shaped feature 28 and channel 30 allows the outer rails 18 and 20 to capture the inner rail 24 so that motion is allowed in one direction (direction labeled X in FIG. 2) while motion is substantially restrained in all other directions. This allows the drawer 12 to slide smoothly into and out of the cabinet 14. This exemplary method is but one of numerous methods of forming the outer rails 16 and 20 and inner rails 24 to form a track and rail arrangement or configuration. All methods of forming outer rails and inner rails such that a track and rail system is accomplished are incorporated herein. Individuals ordinarily skilled in the art know how to form such sliding rail configurations and all such known configurations are encompassed within the invention herein described.

One method of manufacturing or making inner and outer rails is by a roll-form process. In such a process, a sheet of steel or other similar malleable material can be passed through a series of rollers. Each roller bends or otherwise modifies and manipulates the steel sheet. Through this process, the series of rollers slowly modify the steel sheet until the shape or form desired is achieved.

Still referring to FIG. 2, the movement of the inner rail 24 with respect to the outer rails 16 and 20 causes contact surfaces of the inner rail 24 and contact surfaces of the outer rails 16 and 20 to slide along each other. In general, the higher the coefficient of friction between the two components, the more force is needed to create and sustain movement or motion. In addition, the higher the coefficient of friction the more noise that is generally generated by the movement of components. Typically, rails used in friction slide mechanisms are made of steel or other like materials, which have a relatively high coefficient of friction. In addition, formed steel rails may have rough surfaces due to the forming process. These factors can cause difficulty in moving a drawer as well as cause noise upon such movement.

Figure 3:
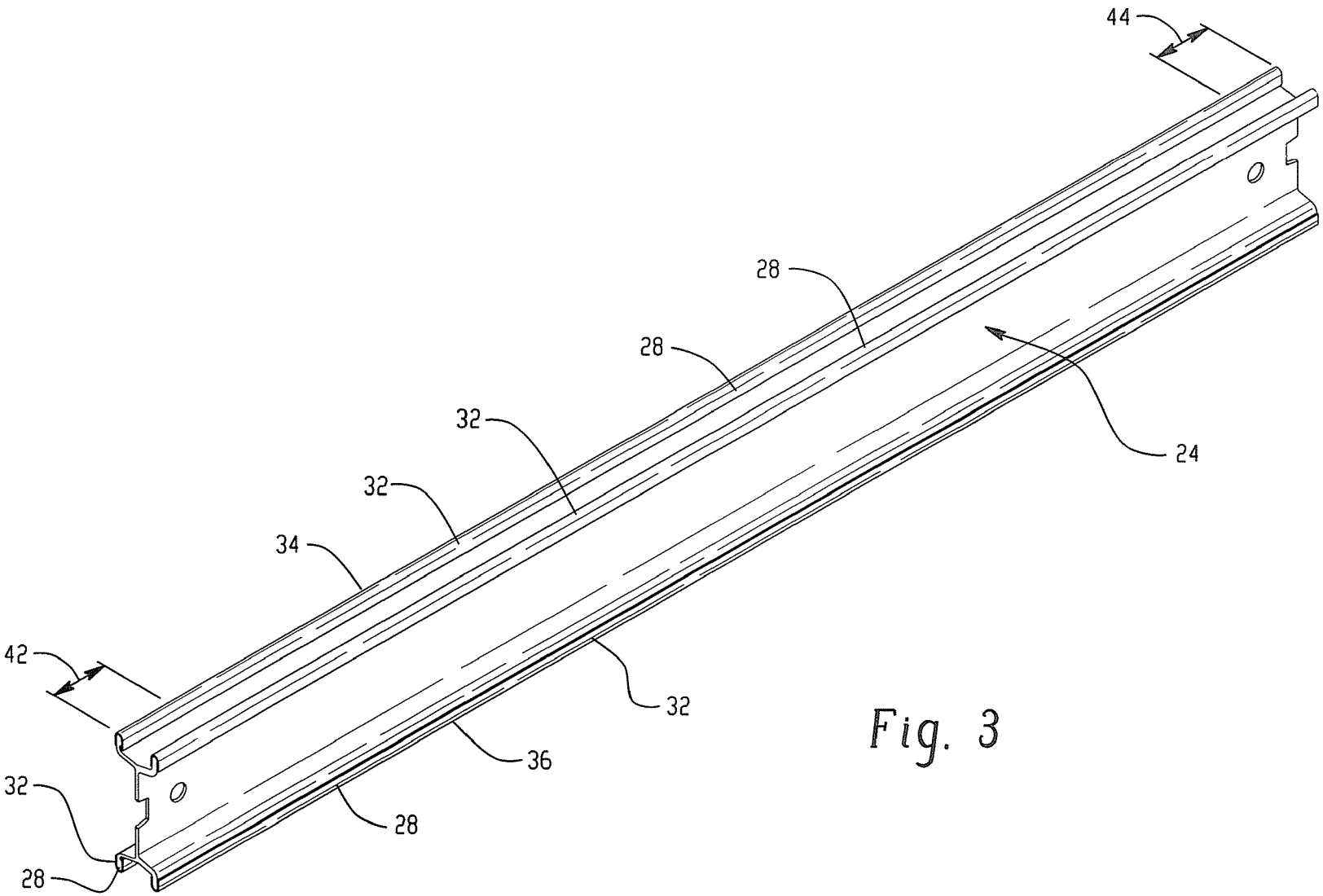
FIG. 3 is a perspective view of an inner rail of a friction slide mechanism of FIG. 1.
Figure 3A:
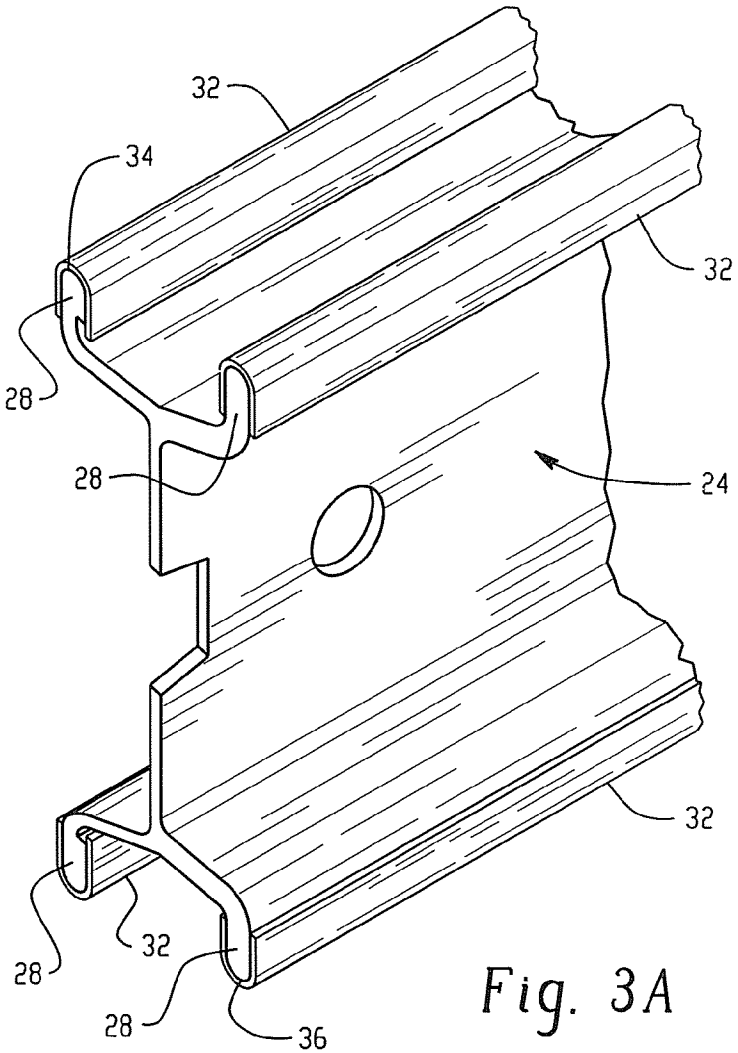
FIG. 3A is a detailed perspective view of portion of the inner rail of FIG. 3.

To reduce the coefficient of friction between the inner and outer rails, a low friction material is disposed or positioned between the inner and outer rails. Referring to FIGS. 3 and 3A, one such example is illustrated. FIGS. 3 and 3A illustrate a low friction material 32 deposited, coupled, or otherwise attached to an upper 34 and a lower 36 surface of the inner rail 24. Low friction material 32 is deposited along the length of the upper and lower surfaces 34 and 36 that contact the outer rails 16 and 20 when the inner rail 24 moves relative to the outer rails 16 and 20. As best shown in FIG. 3A, this includes the top (with reference to the upper surface 34), bottom (with reference to the lower surface 36), and the sides of the u-shaped features 28 of the inner rail 24.

Figure 4:
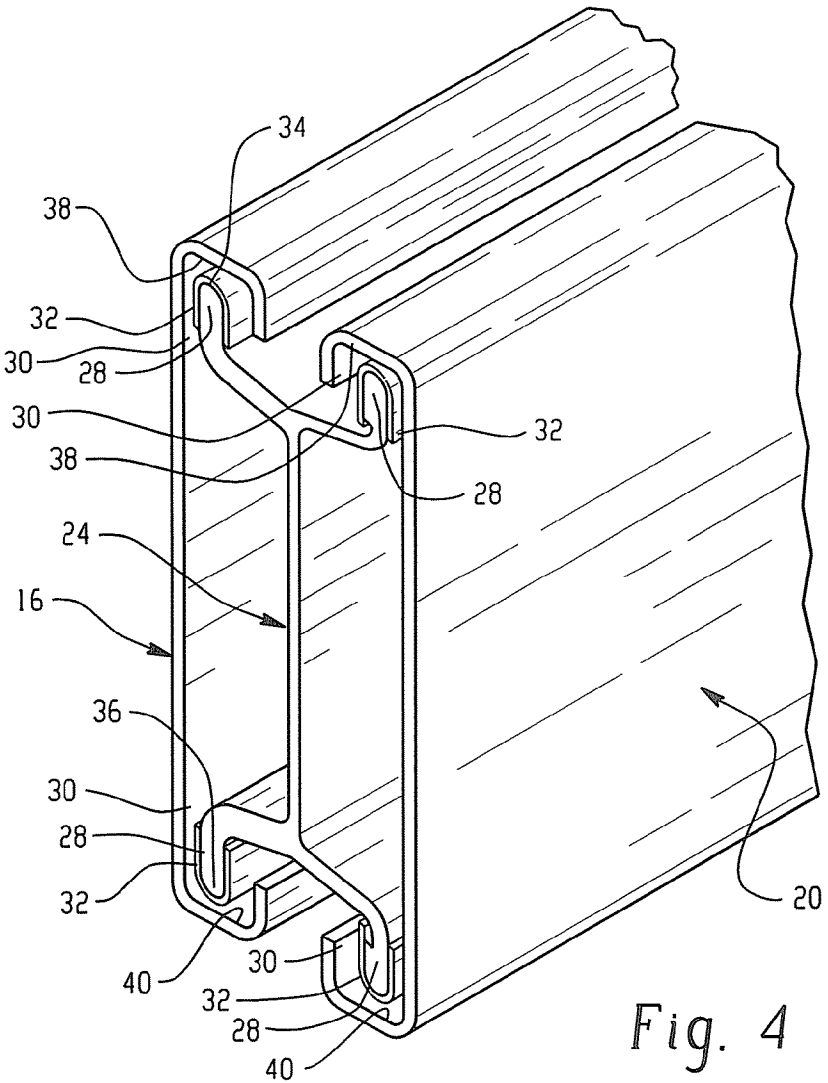
FIG. 4 is a detailed perspective view of a portion of the friction slide mechanism of FIG. 1.

Referring to FIG. 4, when the inner rail 24 is telescopically received by the outer rails 16 and 20, the upper and lower surfaces 34 and 36 of the inner rail 24 are covered with the low friction material 32 such that the low friction material 32 directly contacts the outer rails 16 and 20 instead of the inner rail 24 directly contacting the outer rail 16 and 20. The application of the low friction material 32 can greatly reduce the coefficient of friction experienced between the inner rail 24 and the outer rails 16 and 20 as the inner rail 24 is moved along a path of travel with respect to the outer rails 16 and 20. In addition, if a surface of a rail is rough due to a forming process, the application of a material, such as a low friction material 32, can make the surface relatively smooth. The lowering of the coefficient of friction and the covering of rough surfaces reduce the force needed to move the drawer 12 into and out of the cabinet 14, as well as reducing noise caused by moving the drawer 12.

Figure 9:
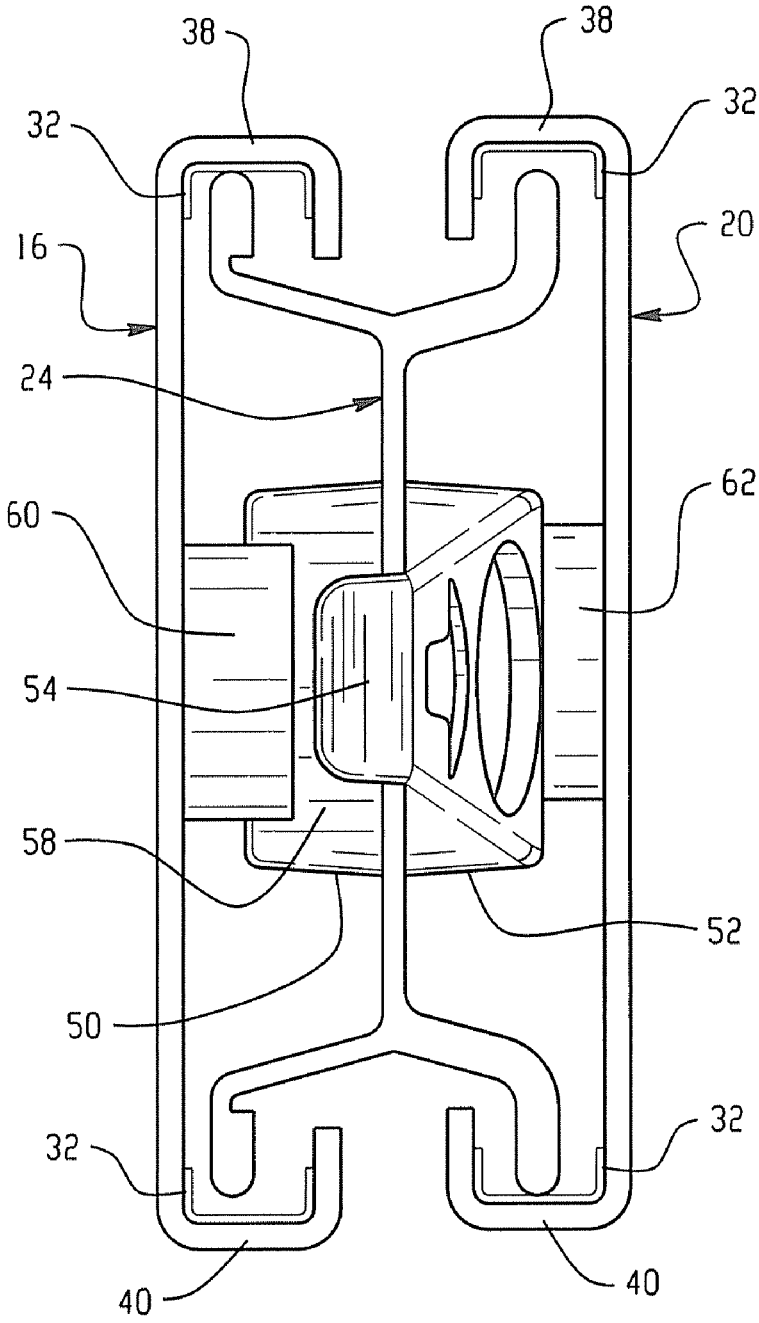
FIG. 9 is a front view of a friction slide mechanism, showing low friction material applied to the outer rails.

In the exemplary illustrations and descriptions herein, the upper and lower surfaces 34 and 36 of the inner rail 24 are covered with low friction material 32 along their entire lengths. It will be appreciated by those skilled in the art that in the practice of the present invention the entire lengths of the upper and lower surface 34 and 36 of the inner rail 24 do not have to be covered with a low friction material 32. Provided a substantial portion of the lengths of the upper or lower surfaces 34 and 36 of the inner rail 24 are covered, the force needed to move the drawer will be sufficiently reduced, as will be the noise created by that movement. An example of a substantial portion of the upper or lower surfaces 34 and 36 is covering approximately 25% of either the upper 34 or lower surface 36 of the inner rail 24, provided the extreme ends 42 and 44 (as best seen in FIG. 3) are part of the 25% covered. FIG. 3 only illustrates the extreme ends 42 and 44 of one of the u-shaped features 28 of the upper surface 34; however, it should be understood that a second u-shaped feature 28 of the upper surface 34 and two u-shaped features 28 of the lower surface 36 have similar extreme ends 42 and 44. The coverage of the low friction material 32 does not have to be continuous in the practice of the present invention. The low friction material 32 can be applied intermittently along the length of the upper or lower surfaces 34 and 36 of the inner rail 24. Further, the low friction material 32 can be intermittently or fully applied to the outer rails 16, 20 as opposed to the inner rail 24, as shown in FIG. 9. The practice of the present invention is also not limited to a particular method of disposing or positioning a low friction material between inner and outer rails.

The low friction material 32 is preferably a polymeric material, such as nylon. Any material that lowers the coefficient of friction between the inner rail 24 and the outer rails 16 and 20 is included in the present invention. Examples of other material that may be used are acetal, ultra high molecular weight polyethylene (UHMWPE), and polytetrafluoroethylene (PTFE, also commonly referred to as TEFLON®).

Although the exemplary illustration shows the low friction material 32 deposited on the upper and lower surfaces 34 and 36 of inner rail 24, the low friction material 32 can be deposited or positioned in a number of ways. For example, low friction material 32 can be deposited, coupled, or otherwise attached to an upper surface 38 or lower surface 40 (see FIG. 9) of the outer rails 16 and 20.

A low friction material 32 can be deposited, coupled, or attached to an inner or outer rail by numerous methods. One such method is through extrusion. An extrusion process can be included in the aforementioned roll-form process for forming rails. Once an inner or outer rail is formed into its desired shape by a series of rollers, the rail may be passed through a die, where a polymeric layer of low friction material can be applied by extrusion to the desired areas of the rail.

Alternatively, the low friction material can be applied as a powder paint coating. One method of applying a powder paint is to dip a component into a fluidized bed of powdered paint. Optionally, the fluidized bed can be electro-statically charged. Another method is to electro-statically charge the powdered paint and spray the paint onto the desired area of the components.

Optionally, an adhesive layer can be applied to a inner or outer rail prior to the low friction material being deposited on, coupled to, or otherwise attached to a rail. The adhesive layer can enhance the bond between the low friction material and the rail, potentially forming a more durable friction slide mechanism. One such adhesive is a thermoplastic elastomer such as SANTOPRENE®. However, any adhesive or other bonding process that enhances the bond between low friction material and a rail is included herein.

A further method of applying a low friction material to inner or outer rails is to pre-form a layer of low friction material as a separate component in a molding or extrusion process. Once the separate component is formed, the layer can be coupled or attached to the inner or outer rail by any suitable method, such as the use of adhesives, fasteners, or snap-arms or clips molded in the component.

Figure 5:
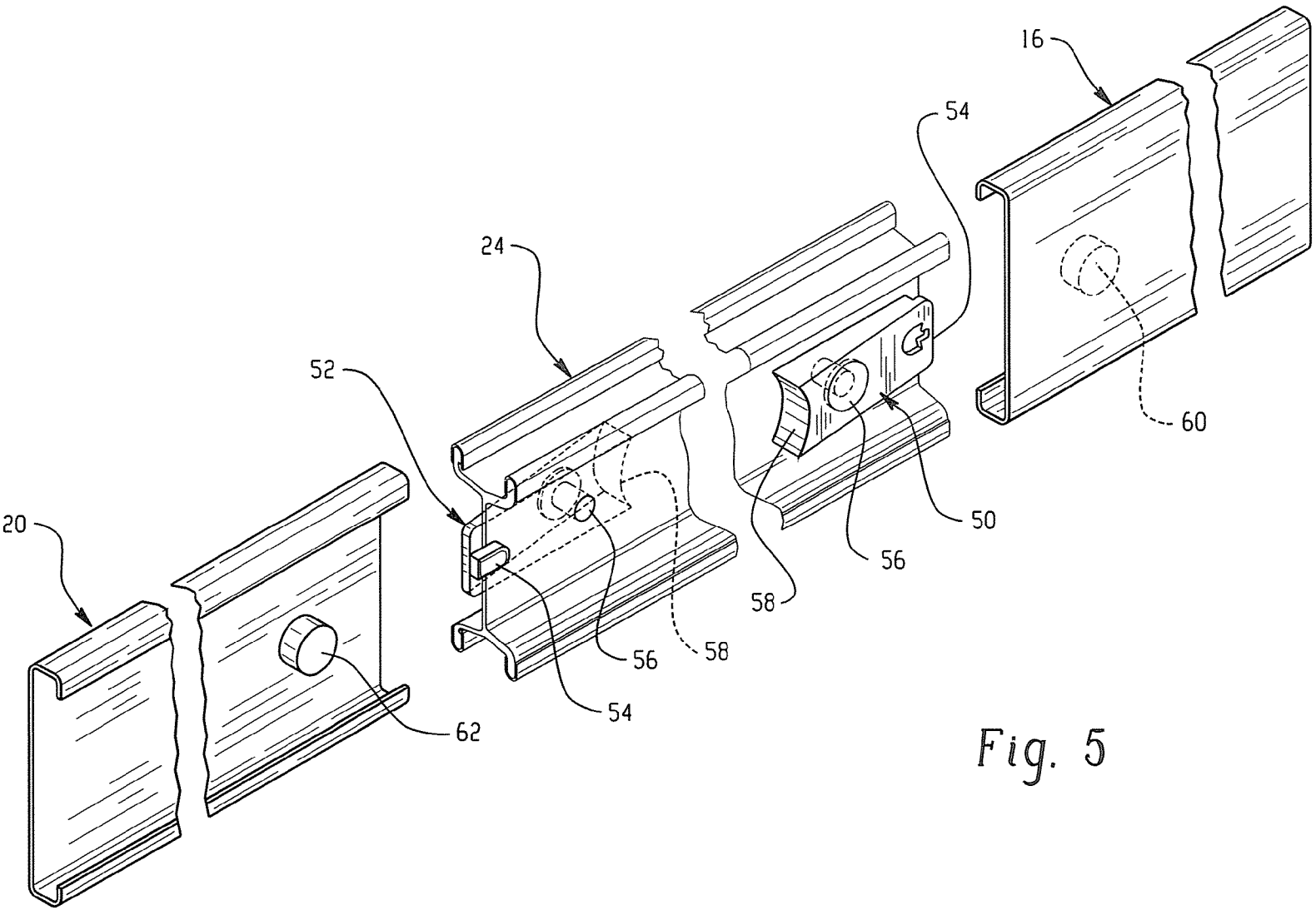
FIG. 5 is an exploded view of a friction slide mechanism of FIG. 1.

As previously mentioned, the relative movement of inner and outer rails can be limited by a system of stops and protrusions. Referring to FIG. 5, an exploded view of an inner rail 24 and two outer rails 16 and 20 is shown. The inner rail 24 is fitted with a first stop 50 and a second stop 52. Each stop is structurally identical, but are described as first stop and second stop for clarity. Each stop 50 and 52 is coupled to the inner rail by a clip 54 and a fastener 56 and includes an impact surface 58. The first outer rail 16 is fitted with a first protrusion 60 and the second outer rail 20 is fitted with a second protrusion 62. Protrusion 60 and 62 can be a separate component that is coupled or attached to outer rails 16 and 20, respectively, or can be formed in the outer rails 16 and 20 by creating a detent or other similar structure in the outer rails 16 and 20.

In the exemplary illustration of FIG. 5, the inner rail 24 is positioned within or adjacent to the outer rails 16 and 20 such that as a drawer 12 is pulled out of a cabinet 14, the motion of the drawer 12 is limited by the contact of the first protrusion 60 with the impact surface 58 of the first stop 50 and the contact of the second protrusion 60 with the impact surface 58 of the second stop 52. As the drawer 12 is pushed back into a cabinet 14, the motion of the drawer is limited by the inherent physical constraints of the cabinet 14. As the drawer 12 is pushed in, either the drawer 12 or the inner rail will contact the back surface of the cabinet 14. Optionally, additional stops and protrusions can be employed to limit the motion of the drawer 12 as it is pushed into the cabinet 14.

Figure 6:
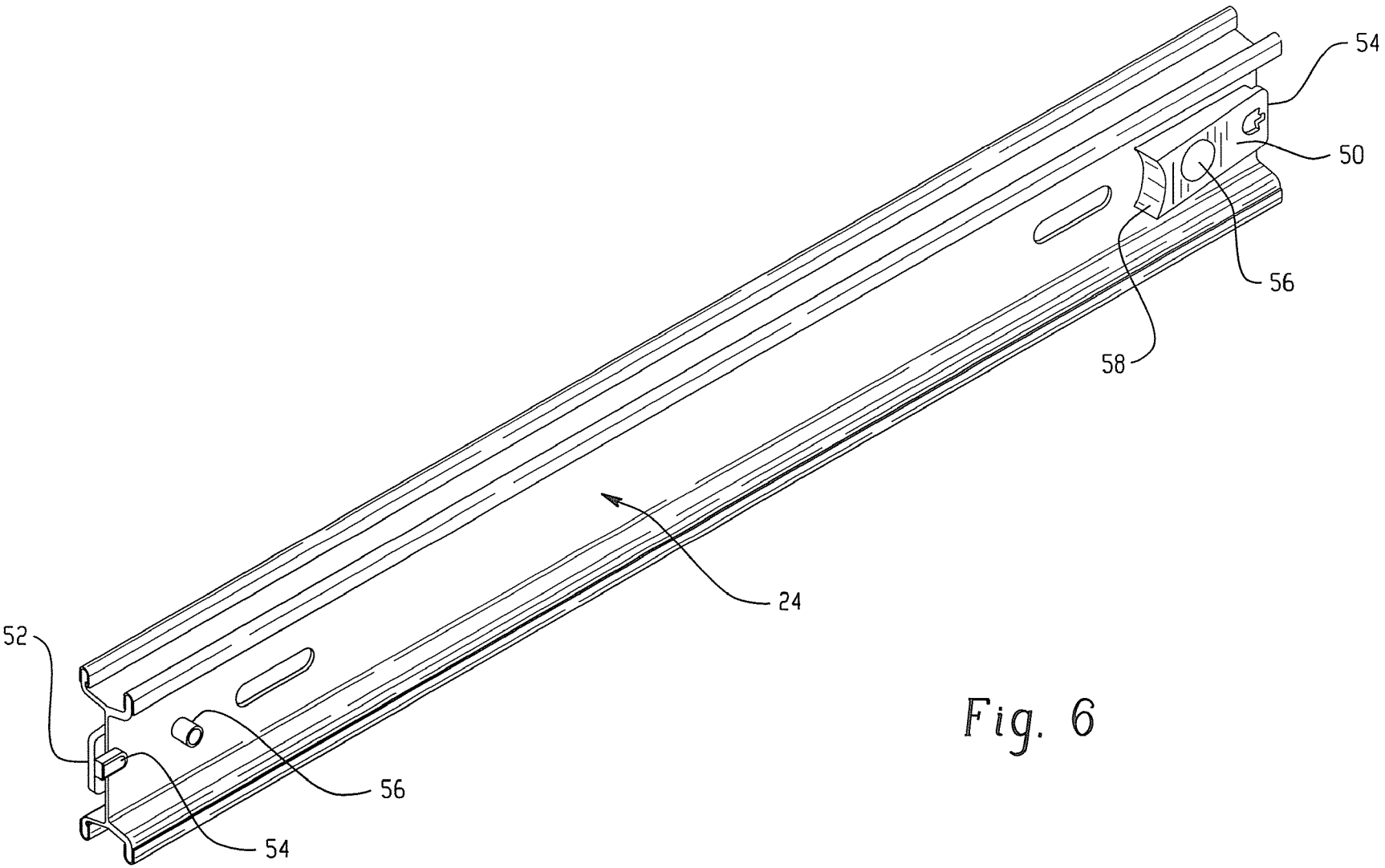
FIG. 6 is a perspective view of an inner rail and a stop of a friction slide mechanism construed in accordance with another embodiment of the present invention.

FIG. 6 shows a detailed view of the attachment of stops 50 and 52 to the inner rail 24. Each stop is attached or coupled to the rail 24 with a fastener 56, such as a rivet or similar device. One of these fastener 56 secures each of the stops 50 and 52 such that as the drawer 12 is opened and closed numerous times, the stops 50 and 52 withstand the impact of the protrusions 60 and 62, respectively, on the stops 50 and 52. Each stop 50 and 52 includes a clip 54. The clip 54 extends over the end of the rail 24 and into contact with the opposite surface of the rail 24 from which the body of the stop 50 and 52 contacts the rail 24, to further attach and align the stop 50 and 52 to the rail 24. The contact of the clip 54 on the opposite side of the rail 24 from where the body of the stop 50 and 52 contacts the rail 24 creates forces that resist the stop 50 and 52 being removed from its attachment to the rail 24. Optionally, the stop 50 can have additional self-fastening features, such as snap-arms and additional clips, molded into the component. These additional self-fastening features could be arranged to make a fastener 56, such as a rivet, unnecessary.

Figure 7A:
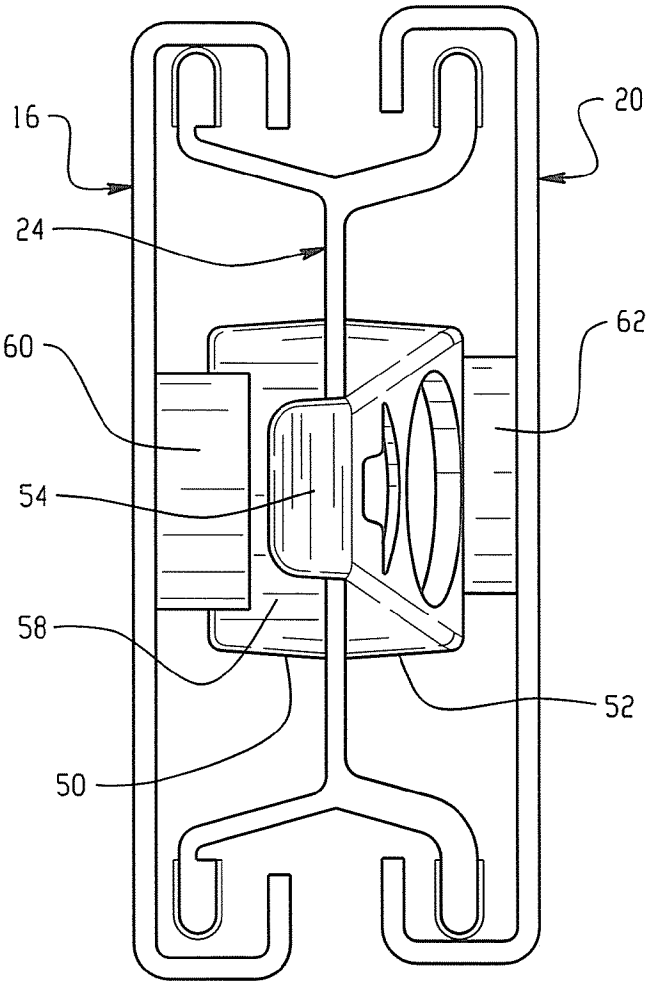
FIG. 7A is a front view of a friction slide mechanism of FIG. 6.
Figure 7:
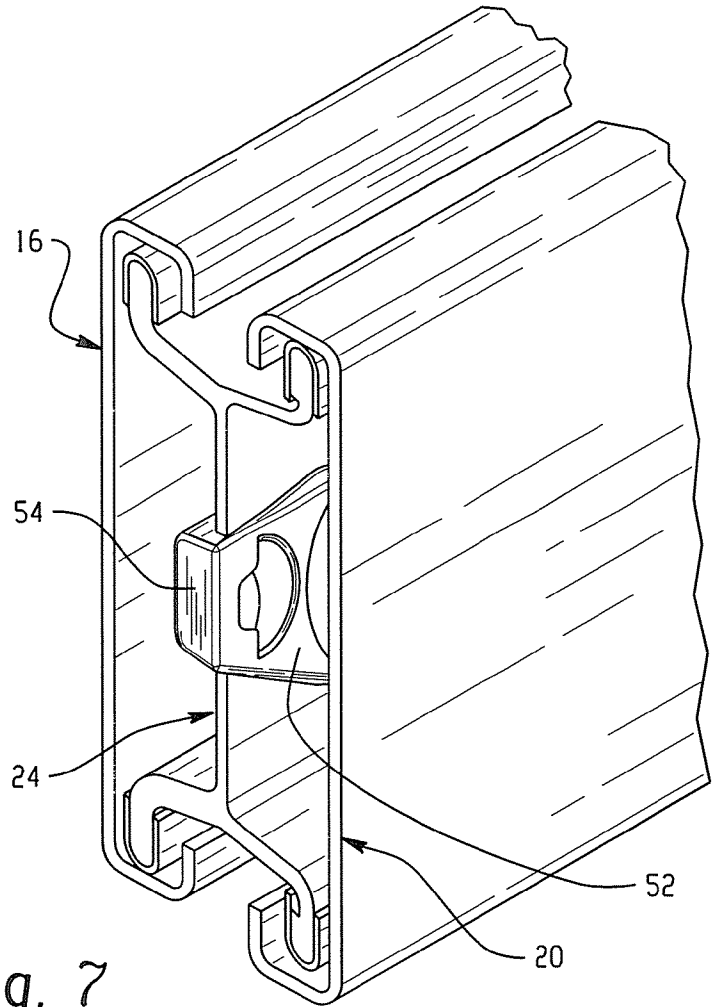
FIG. 7 is a perspective view of a portion of the friction slide mechanism of FIG. 6.

FIGS. 7 and 7A illustrate an assembled friction slide mechanism. FIG. 7 shows two outer rails 16 and 20, an inner rail 24, and a stop 52. In addition, FIG. 7A shows an additional stop 50 and two protrusions 60 and 62. As can be best seen in FIG. 7A, when friction slide components are assembled, protrusion 60 is aligned with impact surfaces 58 of stop 50. As the inner rail 24 and outer rails 16, 20 move relative to one another, the protrusion 60 will contact the impact surface 58 of a stop 50.

Figure 8:
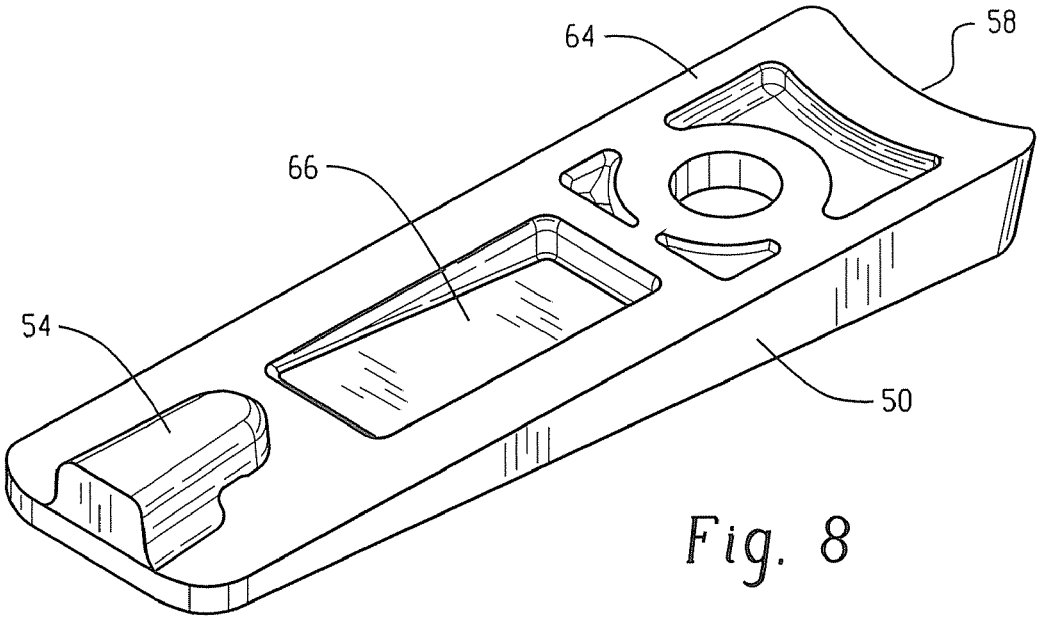
FIG. 8 is a perspective view of a stop of a friction slide mechanism.
Figure 8A:
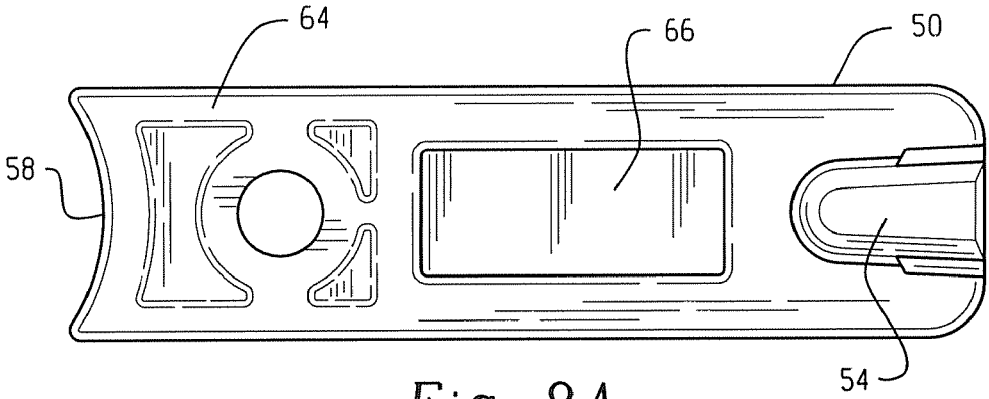
FIG. 8A is a top view of a stop of the friction slide mechanism of FIG. 6.
Figure 8B:
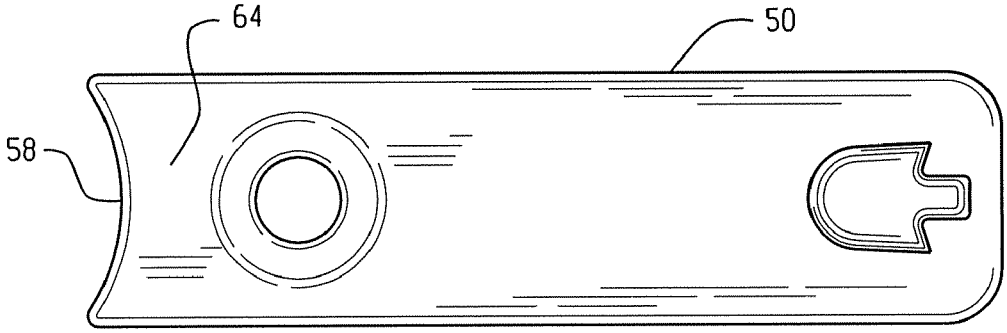
FIG. 8B is a bottom view of a stop of the friction slide mechanism of FIG. 6.

The stop 50 has a number of features that assist in reducing noise generated by the relative movement of the inner 24 and outer rails 16 and 20 as a drawer 12 is pulled in and out of a cabinet 14. FIGS. 8, 8A, and 8B illustrate a stop 50 in greater detail. The exemplary stop 50 can be described as a soft stop because it is typically made or manufactured from an elastomeric or other polymeric material.

As has been described above, a stop 50 extends past the edge of the inner rail 24 and attaches to the opposite surface of the inner rails 24 through the use of a clip 54. This arrangement insures that, as the inner rail 24 is moved linearly (with respect to the outer rails 16 and 20), the stop 50 will come into contact with obstacles before the inner rail 24 does.

As the drawer 12 is moved in and out of the cabinet 14, an inner rail 24 not fitted with a stop 50, can come into contact with both the back of the cabinet 14 and the back of the front facing of the drawer 12. The rail 24, cabinet 14, and drawer 12 are often constructed of steel or similar material, which makes contact between these components noisy and can give the operator of the drawer 12 a jarring sensation. By positioning the stop 50 to extend past the end of the inner rail 24, the stop 50 comes into contact with the steel cabinet 14 and drawer 12 instead of the steel inner rail 24. The stop 50, being constructed of elastomeric materials, absorbs the impact of a cabinet backing or drawer without generating the noise common to a steel on steel contact or creating a jarring sensation for the operator.

The impact surface 58 of the stop 50 is designed to accept a protrusion 60. In the exemplary illustration of FIGS. 8, 8A, and 8B, the impact surface 58 is concave and can accept a round protrusion 60. A protrusion 60 is often formed in an outer rail and can be metal. By utilizing an elastomeric or otherwise polymeric stop 50, the impact between the protrusion 60 and impact surface 58 of the stop 50 will not generate the noise of metal on metal contact. In addition, the stop 50 includes an energy absorption area 64 proximate to the impact surface 58. This area 64 is designed to undergo elastic compression as a protrusion 60 contacts the impact surface 58. In other words, the stop 50 generally, and the energy absorption area 64 specifically, will compress as a force is applied to the impact surface 58 by a protrusion 60. This compression creates a counterforce to resist the force applied to the impact surface 58. Since the material of the stop 50 is elastic, the stop will return to is original form and shape when the force is removed from the impact surface 58. This arrangement not only reduces possible noise generated as the motion of the drawer 12 is limited, it also reduces or eliminates a jarring sensation that would accompany a hard stop arrangement, which would not offer substantial elastic compression.

As can best be seen in FIGS. 8 and 8A, the energy absorption area 64 can include a recession or void 66 to increase the amount of compression the stop can undergo. The size and shape of this recession 66 can be designed based on the size and weight of a drawer and its contents.

While various aspects of the invention are described and illustrated herein as embodied in combination in the exemplary embodiments, these various aspects may be realized in many alternative embodiments not shown, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

We claim:

1. A drawer slide mechanism comprising:

a. a first outer rail including a first protrusion;

b. an inner rail positioned movably adjacent the first outer rail and arranged such that at least a portion of the inner rail remains adjacent the first outer rail throughout its entire range of motion; and c. a first stop coupled to the inner rail and including a first impact surface for contacting the first protrusion when the inner rail is positioned at a first end of its range of motion;

wherein when the first protrusion contacts the first stop, a first energy absorption portion of the first stop undergoes elastic compression to offer elastic resistance to the first outer rail.

2. The drawer slide mechanism of claim 1 wherein the coupling of the first stop to the inner rail is such that the first stop extends past a first end of the inner rail.

3. The drawer slide mechanism of claim 2 wherein the first stop further includes a clip that is in contact with the first end of the inner rail.

4. The drawer slide mechanism of claim 1 further comprising low friction material coupled to one of the inner and first outer rails such that the low friction material is disposed between the inner and first outer rails throughout an entire path of motion between the inner and first outer rails.

5. A drawer slide mechanism comprising:

a. a first elongated track including a first protrusion;

b. a second elongated track including a second protrusion;

c. an elongated rail telescopically received by the first and second elongated tracks to define a path of motion such that the elongated rail remains at least partially received by the first and second elongated tracks along the entire path of motion;

d. a low friction material disposed between the elongated rail and the first and second elongated tracks such that the low friction material remains at least partially disposed between the elongated rail and the first and second elongated tracks throughout the entire path of motion;

e. a first stop including a first impact surface and coupled proximate to a first end of the elongated rail;

f. a second stop including a second impact surface and coupled proximate to a second end of the elongated rail; and wherein the first and second stops are arranged to offer elastic resistance to the first and second elongate rails, respectively.

6. The drawer slide mechanism of claim 5 wherein a contact point between the first protrusion and the first impact surface defines a first end of the path of motion.

7. The drawer slide mechanism of claim 5 wherein the first stop extends past the first end of the elongated rail and the second stop extends past the second end of the elongated rail.

8. The drawer slide mechanism of claim 5 wherein the elastic resistance offered by the first and second stops is due to an energy absorption portion of the first and second stops undergoing elastic compression.

9. A drawer slide mechanism comprising:

a first elongated rail;

a second elongated rail telescopically and movably received by the first elongated rail;

a third elongated rail that telescopically receives the second elongated rail to partially define the path of motion of the rail;

a low friction material coupled to the second elongated rail along second elongated rail surfaces that engage the first and third rails such that the low friction material is disposed between the first elongated rail and the second elongated rail and the second elongated rail and the third elongated rail and such that the low friction material remains at least partially disposed between the first elongated rail and the second elongated rail and the second elongated rail and the third elongated rail throughout an entire path of motion between the first and second and third elongated rails;

first and second stops each coupled to an opposite distal end of the second elongated rail, the stops including first and second impact surfaces, respectively;

a first protrusion on the first elongated rail that is positioned to contact the first impact surface when the first elongated rail is telescopically retracted to an end of its path of motion; and a second protrusion on the third elongated rail that is positioned to contact the second impact surface when the third elongated rail is telescopically retracted to an end of its path of motion;

wherein the first and second stops are arranged to offer elastic resistance to the first and third outer rails, respectively.

10. The drawer slide mechanism of claim 9 wherein the low friction material is coupled to the second elongated rail with an adhesive.

11. The drawer slide mechanism of claim 9 wherein the first elongated rail is coupled to a cabinet housing and the third elongated rail is coupled to a drawer.

12. The drawer slide mechanism of claim 9 wherein the elastic resistance offered by the first and second stops is due to an energy absorption portion of the first stop undergoing elastic compression.

13. The drawer slide mechanism of claim 9 wherein the low friction material is coupled to the second elongated rail substantially continuously along an entire length of the second elongated rail.

14. The drawer slide mechanism of claim 9 wherein the low friction material is coupled to the second elongated rail intermittently along an entire length of the second elongated rail.

15. A drawer slide mechanism comprising:

a first rail comprising:

a first U-shaped surface; and a second U-shaped surface;

a second rail positioned movably along the first rail and arranged such that at least a portion of the second rail remains adjacent the first rail throughout its entire range of motion, the second rail comprising:

a third surface configured to fit within the first U-shaped surface;

a fourth surface configured to fit within the second U-shaped surface;

a fifth surface; and a sixth surface;

wherein the second rail is further arranged such that the first surface is proximate to the third surface and the second surface is proximate to the fourth surface; and a third rail comprising:

a seventh U-shaped surface that is arranged to fit around the fifth surface; and an eighth U-shaped surface that is arranged to fit around the sixth surface;

wherein the second rail is positioned movably adjacent the third rail and arranged such that at least a portion of the second rail remains adjacent the third rail throughout its entire range of motion;

further wherein a low friction material is disposed on said first, second, seventh, and eighth U-shaped surfaces between the first rail and the second rail and second rail and third rail such that it prevents contact between the first and second rails and second rail and third rails substantially along their lengths; and further wherein the drawer slide mechanism further comprises:

first and second stops each coupled to an opposite distal end of the second rail, the stops including first and second impact surfaces, respectively;

a first protrusion on the first rail that is positioned to contact the first impact surface when the first rail is telescopically retracted to an end of its path of motion; and a second protrusion on the third rail that is positioned to contact the second impact surface when the third rail is telescopically retracted to an end of its path of motion;

wherein the first and second stops are arranged to offer elastic resistance to the first and third rails, respectively.

16. The drawer slide mechanism of claim 15 wherein the low friction material is disposed continuously along an entire length of said third, fourth, seventh, and eight U-shaped surfaces between the first rail and the second rail and second rail and third rail such that it prevents contact between the first and second rails and second rail and third rails substantially along their lengths.

17. The drawer slide mechanism of claim 15 wherein the elastic resistance offered by the first and second stops is due to an energy absorption portion of the first stop undergoing elastic compression.

18. A drawer slide mechanism comprising:

a first elongated track comprising:

a first upper channel; and a first lower channel;

a second elongated track comprising:

a second upper channel; and a second lower channel;

an elongated rail comprising:

an upper u-shaped portion wherein the upper u-shaped portion has a first leg that is received by the first upper channel and a second leg that is received by the second upper channel; and a lower u-shaped portion wherein the lower u-shaped portion has a first leg that is received by the first lower channel and a second leg that is received by the second lower channel;

a low friction material disposed on the upper u-shaped portion and the lower u-shaped portion;

first and second stops each coupled to an opposite distal end of the elongated rail, the stops including first and second impact surfaces, respectively;

a first protrusion on the first elongated track that is positioned to contact the first impact surface when the first elongated track is telescopically retracted to an end of its path of motion; and a second protrusion on the second elongated track that is positioned to contact the second impact surface when the second elongated track is telescopically retracted to an end of its path of motion;

wherein the first and second stops are arranged to offer elastic resistance to the first and second elongated tracks, respectively;

further wherein the upper and lower u-shaped portions are received by the upper and lower channels to define a path of motion of the elongated rail; and further wherein the low friction material remains disposed between the upper and lower u-shaped portions and the upper and lower channels throughout the entire path of motion.

19. The drawer slide mechanism of claim 18 wherein the elastic resistance offered by the first and second stops is due to an energy absorption portion of the first stop undergoing elastic compression.

20. The drawer slide mechanism of claim 18 wherein the low friction material is disposed on the upper and lower U-shaped portions substantially continuously along an entire length of the elongated rail.

21. The drawer slide mechanism of claim 18 wherein the low friction material is disposed on the upper and lower U-shaped portions intermittently along an entire length of the elongated rail.

22. A drawer slide mechanism comprising:

a. a first outer rail including a first protrusion;

b. an inner rail positioned movably adjacent the first outer rail and arranged such that at least a portion of the inner rail remains adjacent the first outer rail throughout its entire range of motion;

c. a first stop coupled to the inner rail and including an impact surface for contacting the first protrusion when the inner rail is positioned at a first end of its range of motion; wherein when the first protrusion contacts the first stop, an energy absorption portion of the first stop undergoes elastic compression to offer elastic resistance to the first outer rail;

d. a second outer rail to which the inner rail is positioned movably adjacent, the second outer rail including a second protrusion and arranged such that at least a portion of the inner rail remains adjacent the second outer rail throughout its entire range of motion; and e. a second stop coupled to the inner rail and including an impact surface for contacting the second protrusion when the inner rail is positioned at a first end of its range of motion;

wherein when the second protrusion contacts the second stop, an energy absorption portion of the second stop undergoes elastic compression to offer elastic resistance to the second outer rail.

23. The drawer slide mechanism of claim 22 wherein the coupling of the second stop to the inner rail is such that the second stop extends past a second end of the rail.

24. The drawer slide mechanism of claim 23 wherein the second stop further includes a clip that is in contact with the second end of the inner rail.

25. The slide mechanism of claim 23 wherein the first outer rail is coupled to a cabinet housing and the second outer rail is coupled to a drawer.

* * * * *